US005197415A

United States Patent [19]

Stretch et al.

[11] Patent Number: 5,197,415

[45] Date of Patent: Mar. 30, 1993

[54] WET-BASE, DOWN-FIRED WATER HEATER

[75] Inventors: Gordon W. Stretch; Wilbur L. Haag, Jr., both of Montgomery, Ala.

[73] Assignee: Rheem Manufacturing Company, New York, N.Y.

[21] Appl. No.: 862,366

[22] Filed: Apr. 2, 1992

[51] Int. Cl.[5] ..... F22B 5/00

[52] U.S. Cl. ..... 122/17; 122/13.1; 122/14; 126/362; 126/366; 126/38

[58] Field of Search ..... 122/17, 14, 13.1; 126/362, 366, 368

[56] References Cited

U.S. PATENT DOCUMENTS

| | | | |
|---|---|---|---|
| 3,724,447 | 4/1973 | Parkhill et al. | 126/360 R |
| 4,329,943 | 5/1982 | Schwörer | 122/17 |
| 4,380,215 | 4/1983 | Mendelson | 122/13 |
| 4,445,464 | 5/1984 | Gerstmann et al. | 122/16 |
| 4,492,185 | 1/1985 | Kendall et al. | 122/32 |
| 4,541,410 | 9/1985 | Jatana | 126/362 |
| 4,651,714 | 3/1987 | Granberg | 126/378 |
| 4,685,425 | 8/1987 | Eising | 122/17 |
| 4,699,122 | 10/1987 | Jannemann et al. | 126/362 |

*Primary Examiner*—Edward G. Favors
*Attorney, Agent, or Firm*—Konneker & Bush

[57] ABSTRACT

A fuel-fired, forced draft water heater is provided with a specially designed burner structure and combustion product flow path that permit the heater to operate with improved fuel efficiency, lowered CO and NOx emissions, and an improved water heat input distribution along the vertical length of the heater. The water heater includes a vertically oriented tank with a vent plenum structure formed at the top end of the tank interior and having an outlet passage connectable to an external combustion product vent pipe. A submerged vertical burner tube extends downwardly from the vent plenum and has an open lower end extending into a submerged turn bowl disposed at the bottom end of the tank interior. Extending upwardly from the turn bowl within the tank interior are a plurality of vertical flue tubes that communicate the interiors of the turn bowl and the vent plenum. A vertically elongated perforated conical burner is disposed within the burner tube and is supplied with a throughflow of a pressurized fuel/air mixture that is ignited by an igniter mounted on the top end of the burner. During operation of the water heater, hot combustion products discharged from the conical burner are sequentially flowed downwardly through the burner tube into the submerged turn bowl, upwardly through the flue pipes into the vent plenum, and then outwardly through the vent plenum outlet passage.

18 Claims, 2 Drawing Sheets

WET-BASE, DOWN-FIRED WATER HEATER

BACKGROUND OF THE INVENTION

The present invention relates generally to fuel-fired heating equipment, and more particularly relates to fuel-fired water heaters.

Conventionally constructed fuel-fired water heaters are typically of a one pass, up-fired configuration in which a fuel burner is disposed at the bottom end of the heater water storage tank beneath a tube sheet to which vertical heat transfer tubes are connected. These tubes extend vertically through the water in the interior of the tank, and are appropriately connected at their upper ends to an external combustion product vent pipe. During water heater firing, the hot combustion products generated by the fuel burner make a single upward pass through the vertical tubes, thereby transferring combustion heat to the tank water, before being discharged into the external vent pipe.

This conventional up-fired water heater construction, though widely accepted and utilized over the years, is subject to a variety of well known problems, limitations and disadvantages. For example, particularly where "hard" water is being heated, it tends to create scaling, and resulting hot spots, on the tube sheet and heat transfer tubes which leads to premature tube sheet and/or tube burnout.

Additionally, the one vertical pass of hot combustion gases through the heat transfer tubes typically results in a relatively low combustion efficiency, leading to relatively high CO and NOx emission levels and correspondingly low fuel efficiency. Moreover, the high concentration of burner input at the lower end of the water heater tank is undesirable because during periods of high water drawdown (usually from the top of the tank) there tends to be a substantial temperature gradient between the water in the top portion of the tank and the water in the bottom portion of the tank. The result of this heat input concentration at the bottom of the tank is that during high water supply periods the water exiting the tank can be considerably cooler than desired—particularly in smaller storage capacity water heaters.

Various types of two-pass fuel fired water heaters have been previously proposed in an attempt to avoid or alleviate these undesirable operational characteristics of conventional single-pass, up-fired water heaters. However, to applicants' knowledge, none of them have proven to be entirely satisfactory in meeting these goals. In view of the foregoing, it is accordingly an object of the present invention to provide a fuel-fired water heater that eliminates or substantially minimizes the above-mentioned problems, limitations and disadvantages associated with conventional fuel-fired water heaters of the type generally described above.

SUMMARY OF THE INVENTION

In carrying out principles of the present invention, in accordance with a preferred embodiment thereof, a fuel-fired forced draft water heater is provided with a specially configured combustion system that uniquely permits the water heater to operate with improved fuel efficiency, lowered CO and NOx emissions, and a substantially more evenly distributed burner heat input to the water being heated.

The water heater representatively comprises a vertical tank having an internal chamber adapted to hold a quantity of water. The tank has a top end, a bottom end, an inlet for receiving pressurized water to be heated within the internal chamber, and an outlet for discharging pressurized heated water from the tank on demand.

A vent plenum structure formed within an upper end portion of the tank defines a top end boundary of the internal tank chamber and has an outlet passage extending outwardly through the tank and connectable to an external combustion product vent pipe. An enclosed, hollow turn bowl structure is disposed within a lower end portion of the internal tank chamber and has a top side wall that faces the underside of the vent plenum structure.

The water heater is also provided with a vertically oriented burner tube that extends through the internal tank chamber. The burner tube has a closed upper end extending through the vent plenum and the top tank end, and an open lower end portion extending downwardly through the top side wall of the turn bowl structure and opening into the interior of the turn bowl structure.

A spaced plurality of vertically oriented flue tubes extend through the internal tank chamber. The flue tubes have open upper end portions extending through the underside of the vent plenum structure and opening into its interior, and open lower end portions extending through the top side wall of the turn bowl structure and opening into the interior thereof. Each of the flue tubes, the burner tube and the turn bowl structure, during operation of the water heater, are submerged in and in intimate heat transfer contact with the water within the internal chamber of the tank Supported within and extending along a major upper longitudinal portion of the burner tube is a vertically elongated hollow burner structure having a perforated vertical side wall portion spaced horizontally inwardly from the interior surface periphery of the burner tube. Additionally, fuel/air delivery means are provided for receiving fuel and air from sources thereof creating a pressurized fuel/air mixture, and forcing the fuel/air mixture downwardly through the interior of the burner structure and outwardly through the side wall perforations thereof.

The water heater also includes igniter means, associated with the vertically elongated burner structure, for igniting the pressurized fuel/air mixture exiting the burner structure to thereby create a pressurized flow of hot combustion products that sequentially flow downwardly through the burner tube into the turn bowl structure, upwardly through the flue tubes into the vent plenum structure, and then outwardly through the outlet passage of the vent plenum structure.

According to a feature of the present invention, the vertically elongated hollow burner is preferably of a downwardly and horizontally inwardly tapered, generally conical configuration having a spaced multiplicity of small perforations formed along the entire length of its side wall portion. Representatively, the perforations are circular, have diameters of approximately 0.033", and have a spacing density of about 331 perforations per square inch. This provides the burner with an "open" area of about 28%.

The open upper inlet end of the burner is downwardly offset a substantial distance from the top end of the tank by a vertical, nonperforate burner extension tube connected to the upper end of the burner and through which the fuel/air mixture may be downwardly flowed to the burner inlet. The vertical length of the burner is representatively about two thirds that of the burner tube within which the burner is internally disposed, and the aforementioned igniter means preferably comprise an annular hot surface igniter operatively connected to and outwardly circumscribing an upper end portion of the burner.

The vertical elongation of the burner, and its downward offset from the top end of the water heater tank, eliminate the conventional hot spot at an end of the tank and also spread the burner input heat along a substantial vertical distance within the tank water being heated. This substantially alleviates the problem of unduly cool water being discharged from an upper end portion of the tank during periods of high water drawdown.

Additionally, the vertical elongation of the burner, coupled with the us of the multiple outlet perforations therein results in a correspondingly elongated flame pattern made up of a multiplicity of tiny combustion flames emanating from the vertical side wall portion of the burner along its entire length. This has been found to advantageously reduce the overall CO and NOx emissions of the water heater.

The overall two-pass combustion product flow path defined by the submerged burner tube, flue tubes and turn bowl provides for a considerably more even total combustion heat distribution within the tank water and also provides for improved fuel efficiency in the water. It also significantly reduces scaling and its attendant premature combustion heat transfer structure burnout.

DETAILED DESCRIPTION

Figure 1:
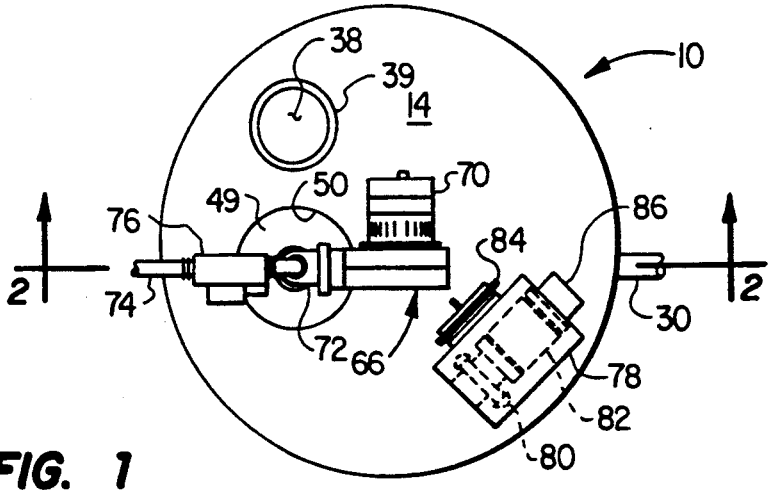
FIG. 1 is a top plan view of a wet-base, down-fired water heater embodying principles of the present invention.
Figure 2:
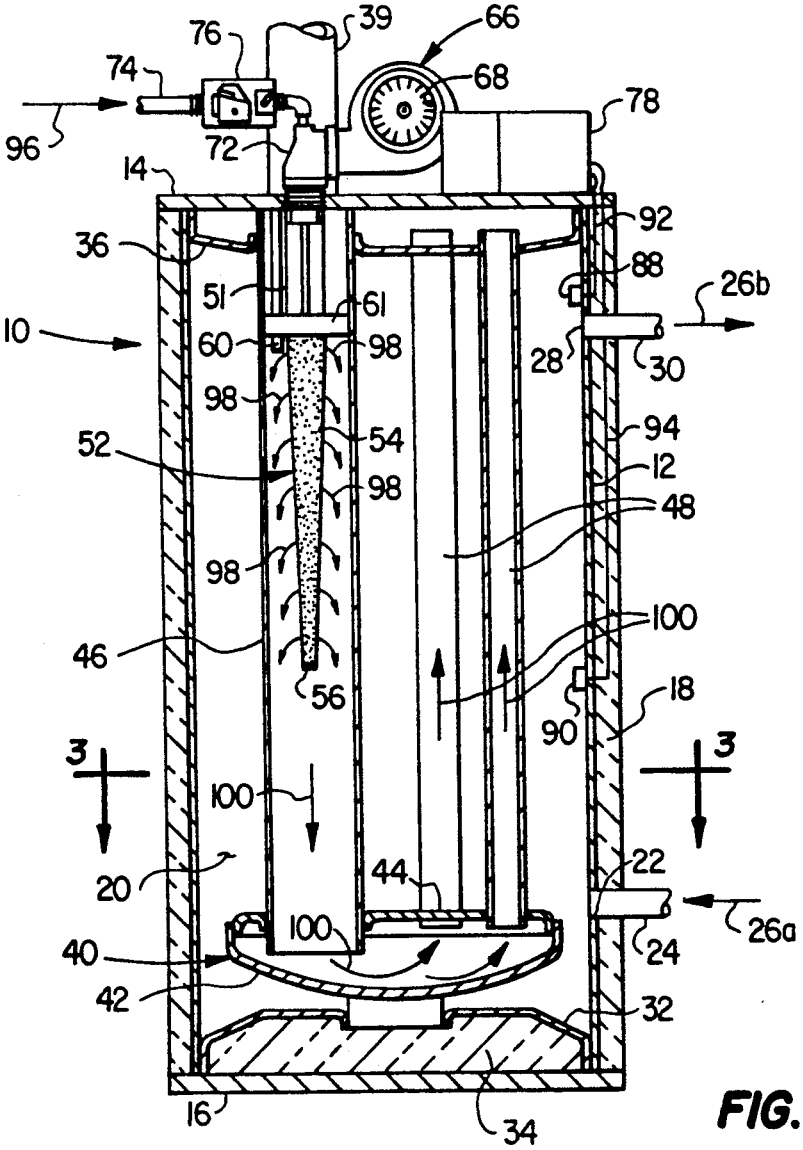
FIG. 2 is a partially cross-sectional view through the water heater taken generally along line 2—2 of FIG. 1.
Figure 3:
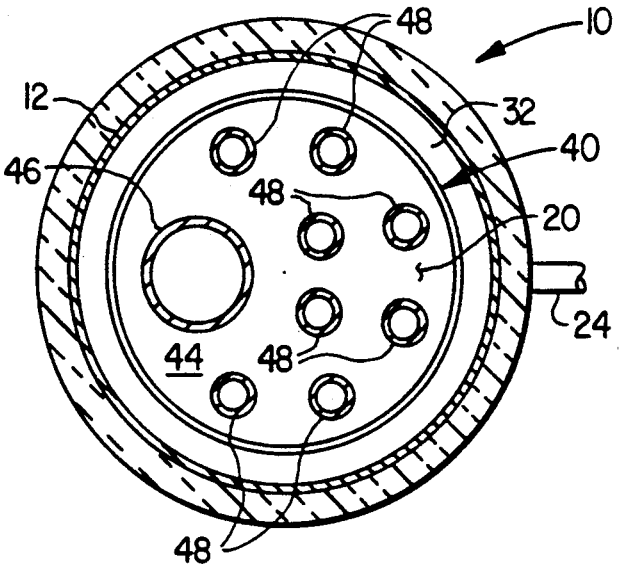
FIG. 3 is a cross-sectional view through the water heater taken along line 3—3 of FIG. 2.

Illustrated in FIGS. 1-3 is a fuel-fired forced draft water heater 10 embodying principles of the present invention and having a unique wet-base, down-fired construction as later described. The water heater 10 includes a vertically oriented cylindrical metal tank 12 having a metal top pan 14, a metal bottom pan 16, an external foam insulation jacket 18, and an internal chamber 20 filled with water to be heated and stored within the tank.

A lower end portion of the tank 12 is provided with an inlet opening 22 to which an inlet pipe 24 may be connected to flow pressurized water 26a into the tank to be heated therein as subsequently described. An upper end portion of the tank 12 is provided with an outlet opening 28 to which a supply pipe 30 may be connected to discharge heated water 26b from the tank on demand.

Disposed within a lower end portion of the tank 12 is a hollow bottom head structure 32, filled with fiberglass insulation material 34, that defines the lower end boundary of the water filled internal chamber 20. A vent plenum structure 36 is formed within an upper end portion of the tank 12, along the underside of the top pan 14, and has an outlet passage 38 that may connected to an external combustion product vent pipe 39. For purposes later described, a hollow metal turn bowl structure 40, submerged within the water in the internal tank chamber 20, is secured to the top side of the bottom head structure 32. The turn bowl 40 has a generally circular shape, a diameter somewhat smaller than that of the tank, a downwardly curved bottom wall 42, and a generally flat top wall 44.

Also submerged within the internal tank chamber 20, and in intimate heat transfer contact with the water therein, are a vertically oriented burner tube 46 and a spaced series of eight vertically oriented, smaller diameter flue pipes 48. The closed upper end 49 of the burner tube 46 extends upwardly through the bottom wall of the vent plenum structure 36 and is sealingly received in a circular opening 50 in the top pan 14, while the open lower end of the burner tube extends downwardly through the top side wall 44 of the turn bowl 40 into the interior of the turn bowl and is spaced upwardly apart from the curved bottom turn bowl wall 42. The open upper and lower ends of the flue tubes 48 respectively extend short distances through the bottom wall of the vent plenum structure 36 and the top side wall 44 of the turn bowl 40. The interiors of the vent plenum structure and the turn bowl are thus communicated through the eight flue tubes 48.

A burner extension tube 51 passes downwardly through the upper burner tube end 49 coaxially into an upper end portion of the larger diameter burner tube 46. The open upper end of a specially designed, vertically elongated burner structure 52, also disposed within the burner tube 46, is connected to and communicates with the open lower end of the burner extension tube 51.

Figure 4:
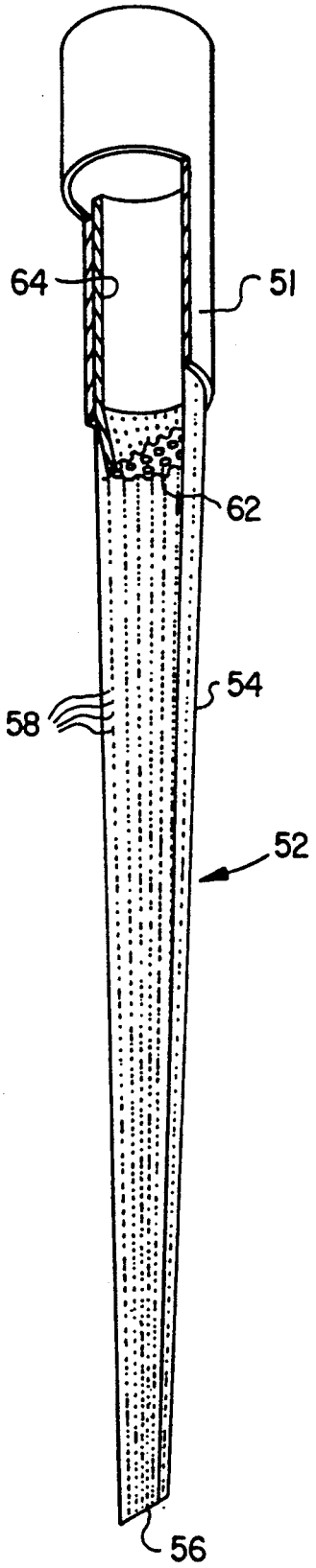
FIG. 4 is an enlarged scale, partially cut away perspective view of an elongated, perforated conical burner tube used in the water heater.

As best illustrated in FIGS. 2 and 4, the burner structure 52 has a stainless steel body portion 54 with a downwardly and horizontally inwardly tapered conical shape, a vertical length approximately two thirds that of the burner tube 46, a closed lower end 56, and a spaced multiplicity of small circular side wall perforations 58 along its length. The perforations representatively have diameters of approximately 0.033" and have a spacing density of approximately 331 perforations per square inch. Accordingly, the side wall portion of the burner body 54 has an open area of about 28%.

A hot surface igniter 60 (FIG. 2) is operatively mounted on and parallel to the upper end of the perforated burner body 54, the igniter projecting downwardly beyond an insulating ceramic fiber ring at the top end of the burner body. As best illustrated in FIG. 4, a circular stainless steel diffuser grid 62 is supported within the burner body 54, just beneath its upper end, by a pair of diffuser hanger rods 64 (only one of which is visible) welded to the inner surface of the burner extension tube 51.

Referring now to FIGS. 1 and 2, the primary external operating and control components of the water heater 10 are conveniently mounted atop the top pan 14 and include a forced draft combustion air blower 66 having an air inlet 68, an electric drive motor 70, and an outlet pipe 72 connected to the upper end of the burner extension tube 51; a ga inlet pipe 74 connected to the outlet pipe 72 and having a gas valve 76 operatively connected therein; and a control box 78. Disposed within the control box 78 are a transformer 80 and a conventional ignition control circuit 82 operatively connected to the hot surface igniter 60.

A vacuum switch 84 externally mounted on the control box 78 is used in a conventional manner to prove air flow through the blower 66 before enabling operation of the igniter 60. Also externally mounted on the control box 78 is a thermostat 86 used to adjustably regulate the temperature of hot water stored in the insulated tan 12. The thermostat 86 continuously senses the temperature of water within tank 12 by means of upper and lower thermostatic sensing well structures 88 and 90 horizontally recessed into the tank interior and operatively connected to thermostat 86 by a pair of conduits 92,94 disposed within the tank insulating jacket 18.

During firing of the water heater 10, as called for by the thermostat 86, combustion air from the blower 66 and gaseous fuel 96 flowing inwardly through the opened gas valve 76 are flowed into the outlet pipe 72 to form a fuel/air mixture that is forced downwardly through the burner extension tube 51, across the burner diffuser 62 and into the interior of the elongated conical burner body 54. The pressurized fuel/air mixture is then forced outwardly through the multiplicity of burner body perforations 58 and ignited by the energized igniter 60 to create a corresponding multiplicity of very small flames 98 around the lateral periphery of the burner body within the vertical burner tube 46.

Flames 98, in turn, create hot combustion gases 100 that are sequentially forced downwardly through the lower end of the burner tube 46 into the submerged turn bowl 40, upwardly through the vertical flue pipes 48 into the vent plenum structure 36, and then into the combustion product vent pipe 39 through the vent plenum outlet passage 38.

The water heater 10 of the present invention provides a variety of operational advantages over conventionally configured fuel fired water heaters. For example, the vertical elongation of the burner, and its downward offset from the top end of the water heater tank, eliminate the conventional hot spot at an end of the tank and also spread the burner input heat along a substantial vertical distance within the tank water being heated. This substantially alleviates the problem of unduly cool water being discharged from an upper end portion of the tank during periods of high water drawdown.

Additionally, the vertical elongation of the burner, coupled with the use of the multiple outlet perforations therein results in a correspondingly elongated flame pattern made up of a multiplicity of tiny combustion flames emanating from the vertical side wall portion of the burner along its entire length. This has been found to advantageously reduce the overall CO and NOx emissions of the water heater.

The overall two-pass combustion product flow path defined by the submerged burner tube, flue tubes and turn bowl provides for a considerably more even total combustion heat distribution within the tank water and also provides for improved fuel efficiency in the water. It also significantly reduces scaling and its attendant premature combustion heat transfer structure burnout.

The foregoing detailed description is to be clearly understood as being given by way of illustration and example only, the spirit and scope of the present invention being limited solely by the appended claims.

What is claimed is:

1. A forced draft, fuel-fired water heater comprising:

vertical tank having an internal chamber adapted to hold a quantity of water, said tank having a top end, a bottom end, an inlet for receiving pressurized water to be heated within said internal chamber, and an outlet for discharging pressurized heated water from said internal chamber;

a vent plenum structure formed within a top end portion of said tank, downwardly adjacent the underside of said top end thereof, and defining a top end boundary of said internal chamber, said vent plenum structure having an outlet passage extending outwardly through said tank and connectable to an external combustion product vent pipe;

an enclosed, hollow turn bowl structure disposed within a lower end portion of said internal chamber and having a top side wall;

a vertically oriented burner tube extending through said internal chamber, said burner tube having a closed upper end positioned adjacent said top end of said tank, and an open lower end portion extending downwardly through said top side wall of said turn bowl structure and opening into the interior of said turn bowl structure;

a spaced plurality of vertically oriented flue tubes extending through said internal chamber, said flue tubes having open upper end portions extending through the underside of said vent plenum structure and opening into the interior of said vent plenum structure, and open lower end portions extending through said top side wall of said turn bowl structure and opening into the interior of said turn bowl structure, each of said flue tubes, said burner tube and said turn bowl structure, during operation of said water heater, being submerged in and in intimate heat transfer contact with water within said internal chamber of said tank;

a vertically elongated hollow burner structure supported within and extending along a major upper longitudinal portion of said burner tube, said hollow burner structure having a perforated vertical side wall portion spaced horizontally inwardly from the interior surface periphery of said burner tube;

fuel/air delivery means for receiving fuel and air from sources thereof, creating a pressurized fuel/air mixture, and forcing the fuel/air mixture downwardly through the interior of said burner structure and outwardly through the side wall perforations thereof; and igniter means, associated with said burner structure, for igniting the pressurized fuel/air mixture exiting said burner structure to thereby create a pressurized flow of hot combustion products that sequentially flow downwardly through said burner tube into said turn bowl structure, upwardly through said flue tubes into said vent plenum structure, and then outwardly through said outlet passage of said vent plenum structure.

2. The water heater of claim 1 wherein:

said burner structure has a top inlet end downwardly offset a substantial distance from said top end of said tank.

3. The water heater of claim 2 wherein said fuel/air delivery means include:

a nonperforate burner extension tube through which a fuel air/ mixture may be flowed into said top inlet end of said burner structure, said burner extension tube having an upper inlet end positioned adjacent said top end of said tank, and a bottom outlet end positioned beneath said vent plenum structure and supportingly connected to said top inlet end of said burner structure.

4. The water heater of claim 3 wherein:
said burner structure has a vertical length approximately two thirds that of said burner tube.

5. The water heater of claim 1 wherein:
said burner structure has a vertical length approximately two thirds that of said burner tube.

6. The water heater of claim 1 wherein said burner structure has:
a downwardly and horizontally inwardly tapered, generally conical configuration,
an open upper inlet end, and
a perforated diffuser structure supported within said burner structure downwardly adjacent said open upper inlet end thereof.

7. The water heater of claim 1 wherein:
said burner structure has a downwardly and horizontally inwardly tapered, generally conical configuration, and
said igniter means include a hot surface igniter disposed adjacent an upper end portion of said burner structure.

8. A forced draft, fuel-fired water heater comprising:
a vertical tank having an internal chamber adapted to hold a quantity of water, said tank having a top end, a bottom end, an inlet for receiving pressurized water to be heated within said internal chamber, and an outlet for discharging pressurized heated water from said internal chamber;
a vent plenum structure formed within a top end portion of said tank, downwardly adjacent the underside of said top end thereof, and defining a top end boundary of said internal chamber, said vent plenum structure having an outlet passage extending outwardly through said tank and connectable to an external combustion product vent pipe;
an enclosed, hollow turn bowl structure disposed within a lower end portion of said internal chamber and having a top side wall;
a vertically oriented burner tube extending through said internal chamber, said burner tube having a closed upper end positioned adjacent said top end of said tank, and an open lower end portion extending downwardly through said top side wall of said turn bowl structure and opening into the interior of said turn bowl structure;
a spaced plurality of vertically oriented flue tubes extending through said internal chamber, said flue tubes having open upper end portions extending through the underside of said vent plenum structure and opening into the interior of said vent plenum structure, and open lower end portions extending through said top side wall of said turn bowl structure and opening into the interior of said turn bowl structure,
each of said flue tubes, said burner tube and said turn bowl structure, during operation of said water heater, being submerged in and in intimate heat transfer contact with water within said internal chamber of said tank;
a burner extension tube through which a fuel/air mixture may be flowed, said burner extension tube vertically extending downwardly into said burner tube and having an upper inlet end positioned adjacent said top end of said tank, and a bottom outlet end positioned beneath said vent plenum structure;
a vertically elongated hollow burner structure disposed within and extending along a major upper longitudinal portion of said burner tube, said hollow burner structure having a perforated vertical side wall portion spaced horizontally inwardly from the interior surface periphery of said burner tube, and an open upper inlet end secured to said bottom outlet end of said burner extension tube, said burner structure having:
a downwardly and horizontally inwardly tapered conical configuration, and
a perforated diffuser structure supported within an upper end portion thereof;
fuel/air delivery means for receiving fuel and air from sources thereof, creating a pressurized fuel/air mixture, and forcing the fuel/air mixture downwardly through said burner extension tube and the interior of said burner structure and then outwardly through the side wall perforations of said burner structure; and
a hot surface igniter positioned adjacent an upper end portion of said burner structure and operable to ignite the pressurized fuel/air mixture exiting said burner structure to thereby create a pressurized flow of hot combustion products that sequentially flow downwardly through said burner tube into said turn bowl structure, upwardly through said flue tubes into said vent plenum structure, and then outwardly through said outlet passage of said vent plenum structure.

9. The hot water heater of claim 8 wherein:
said burner structure has a vertical length about two thirds that of said burner tube.

10. The hot water heater of claim 8 wherein:
said burner structure is of a stainless steel construction, and
said vertical side wall portion of said burner structure has a spaced multiplicity of small perforations formed along substantially its entire vertical length.

11. The hot water heater of claim 10 wherein:
said perforations are circular and have diameters of approximately 0.033", and
said perforations have a spacing density of approximately 331 perforations per square inch.

12. The hot water heater of claim 8 wherein:
said fuel/air delivery means include a draft inducing combustion air supply fan mounted on said top end of said tank and having an outlet pipe operatively connected to said top end of said burner extension tube, and a gaseous fuel supply line connected to said outlet pipe and having a gas valve installed therein.

13. The hot water heater of claim 12 further comprising control means, mounted on said top end of said tank, for controlling the operation of said water heater, said control means including:
an ignition control circuit operatively connected to said hot surface igniter,
a vacuum switch operatively connected to said supply fan, and
a thermostat having at least one water temperature sensing element disposed within said internal tank chamber.

14. A fuel-fired water heater comprising:
a tank having an internal chamber adapter to hold a quantity of water, said internal chamber having top and bottom ends; and
means for heating water disposed within said internal chamber, including:

a vertically oriented burner tube disposed within said internal chamber and having a top end disposed adjacent said top end of said internal chamber, and a bottom end disposed adjacent said bottom end of said internal chamber, a vertically elongated hollow burner structure disposed within and extending along a major upper longitudinal portion of said burner tube, said burner structure having a downwardly and horizontally inwardly tapered, generally conical configuration, a vertical side wall portion having a spaced multiplicity of small perforations formed therethrough, and an open upper inlet end downwardly offset a substantial distance from said top end of said tank, means for sequentially forcing a fuel/air mixture downwardly into said upper inlet end of said burner structure and through the interior of said burner structure, outwardly through the burner structure side wall perforations, and then downwardly through the portion of said burner tube beneath said burner structure, and means for igniting the fuel/air mixture as it exits the side wall perforations of said burner structure.

15. The hot water heater of claim 14 wherein:

said means for igniting include a hot surface igniter positioned adjacent an upper end portion of said burner structure.

16. The hot water heater of claim 14 wherein:

said burner structure has a perforated diffuser structure disposed within an upper end portion thereof.

17. The hot water heater of claim 14 wherein:

the vertical length of said burner structure is approximately two thirds that of said burner tube.

18. The hot water heater of claim 15 wherein:

said perforations are circular and have diameters of approximately 0.033", and said perforations have a spacing density of approximately 331 perforations per square inch.

* * * * *

UNITED STATES PATENT AND TRADEMARK OFFICE

CERTIFICATE OF CORRECTION

PATENT NO. : 5,197,415

DATED : March 30, 1993

INVENTOR(S) : Gordon W. Stretch and Wilbur L. Haag

It is certified that error appears in the above-identified patent and that said Letters Patent is hereby corrected as shown below:

Column 2, line 40, after the word "thereof" insert a --,--.

Column 3, line 17, "us" should be --use--.

Column 5, line 3, "tan" should be --tank--.

Column 8, line 64, "adapter" should be --adapted--.

Signed and Sealed this

Twenty-ninth Day of March, 1994

*Attest:*

Bruce Lehman

BRUCE LEHMAN

*Attesting Officer*

*Commissioner of Patents and Trademarks*